US007584527B2

(12) United States Patent
Jones

(10) Patent No.: US 7,584,527 B2
(45) Date of Patent: Sep. 8, 2009

(54) COMBINATION LOGO PIN HOLDER AND EYEGLASSES HOLDER

(76) Inventor: Ronald G. Jones, 3673 Western Ave., Alton, IL (US) 62002

( * ) Notice: Subject to any disclaimer, the term of this patent is extended or adjusted under 35 U.S.C. 154(b) by 619 days.

(21) Appl. No.: 11/243,736

(22) Filed: Oct. 6, 2005

(65) Prior Publication Data

US 2008/0148528 A1 Jun. 26, 2008

(51) Int. Cl.
*A45F 5/00* (2006.01)

(52) U.S. Cl. ..... 24/3.3

(58) Field of Classification Search ..... 24/3.3, 24/13, 30.5 S, 563, 103; 40/1.5, 1.6; 351/155, 351/158, 112; 63/20, 1.16–1.18
See application file for complete search history.

(56) References Cited

U.S. PATENT DOCUMENTS 3,374,508 A * 3/1968 Slimovitz ..... 24/3.1
5,141,104 A * 8/1992 Morrow et al. ..... 206/5
5,319,838 A * 6/1994 Eppenauer ..... 24/3.3
5,343,599 A * 9/1994 Reeves ..... 24/36
5,426,828 A * 6/1995 Kusano ..... 24/105
5,956,816 A * 9/1999 McCrink ..... 24/113 MP

* cited by examiner

*Primary Examiner*—James R Brittain
(74) *Attorney, Agent, or Firm*—Charles McCloskey

(57) ABSTRACT

A combination logo pin holder and eyeglasses holder has a generally elliptical body portion that has a plurality of outwardly extending projections upon its perimeter. The projections have downwardly extending portions, and the body portion has an elongated slot in its middle with fastener openings at either end of the slot. A base portion extends outwardly from the bottom of the body portion and has elongated grooves therein. An eyeglass frame member is then inserted within the grooves so the hinge of an eyeglass frame rests upon the base portion at the body portion.

1 Claim, 3 Drawing Sheets

COMBINATION LOGO PIN HOLDER AND EYEGLASSES HOLDER

I FIELD OF THE INVENTION

The present invention relates to eyeglass holders, particularly eyeglass holders intended to be attached to a user's outer garments.

II BACKGROUND OF THE INVENTION

The present invention fulfills a need to securely retain a pair of eyeglasses, sunglasses, or the like to the outer garments of a user. Placing glasses in an outside pocket may result in loss or damage to the glasses, and in the absence of a pocket (such as when the user is wearing a ski jacket), there is no place to secure glasses in the event the user removes them from his or her face. The present invention is intended to be used in conjunction with a logo pin featuring one of various designs, employing the pin to affix the eyeglass holder to the user's garment. As a further advantage, a set of flexible fingers integral to the eyeglass holder press against the temple piece of the glasses, preventing them from falling out of the holder.

U.S. Pat. Des. 152,254 discloses a holder for eyeglasses. This invention differs from the present invention in that it is designed to be mounted to a vertical surface such as a wall, filing cabinet, auto dashboard, or the like. There are no provisions that allow it to be affixed to a garment, nor does it allow for holding a logo pin or the like.

U.S. Pat. Des. 173,295 discloses a holder for a pair of spectacles. This invention differs from the present invention in that it is designed to be mounted to a vertical surface such as a wall, filing cabinet, auto dashboard, or the like. There are no provisions that allow it to be affixed to a garment, nor does it allow for holding a logo pin or the like.

U.S. Pat. No. 851,327 discloses an eyeglass holder. This invention is designed to be pinned to a user's outer garment, and hold the glasses horizontally by means of a spring clip. The vertical pendulous position of the present invention is the preferred method to avoid damage, and allows for easier removal of the eyeglasses. Further, this invention does not allow for holding a logo pin or the like.

U.S. Pat. No. 2,997,270 discloses racks for spectacles. This invention differs from the present invention in that it is designed to be mounted to a vertical surface such as a wall, filing cabinet, or the like. There are no provisions that allow it to be affixed to a garment, nor does it allow for holding a logo pin or the like.

U.S. Pat. No. 3,259,348 discloses an eyeglass holder. This invention differs from the present invention in that it is designed to be mounted to a vertical surface such as a wall, filing cabinet, or the like. There are no provisions that allow it to be affixed to a garment, nor does it allow for holding a logo pin or the like.

U.S. Pat. No. 4,239,167 discloses a wall-mounted eyeglass holder. This invention differs from the present invention in that it is designed to be mounted to a vertical surface such as a wall, filing cabinet, auto dashboard, or the like. There are no provisions that allow it to be affixed to a garment, nor does it allow for holding a logo pin or the like.

U.S. Pat. Nos. 4,452,354, 4,702,451, and 5,046,696 disclose eyeglass holders. These inventions differ from the present invention in that they are designed to be mounted to a vertical surface such as a wall, filing cabinet, or the like. There are no provisions that allow them to be affixed to a garment, nor do they allow for holding a logo pin or the like.

U.S. Pat. No. 4,695,026 discloses a holder for eyeglasses. This invention differs from the present invention in that it is designed to be mounted to a vertical surface such as a wall, filing cabinet, auto dashboard, or the like. There are no provisions that allow it to be affixed to a garment, nor does it allow for holding a logo pin or the like.

U.S. Pat. No. 4,894,887 discloses an eyeglass retainer. This invention is designed to be clipped onto a user's pocket or belt. There is no way to use this invention on a garment that does not possess a pocket or other means to insert its integral clip. Further, this invention depends upon the weight of the glasses to hold them in place. The present invention does not have means to positively retain the glasses, nor does it allow for holding a logo pin or the like.

III SUMMARY OF THE INVENTION

A. Summary

The combination logo pin holder and eyeglasses holder comprises a single piece of molded plastic that achieves all objects of the invention.

B. Objects of the Invention

One object of the present invention is to hold glasses securely to the garment of the user.

Another object of the present invention is to prevent glasses from falling out of the holder.

Another object of the present invention is to allow the user to easily insert into and remove glasses from the holder.

Another object of the present invention is to use the spike and clasp of a commercially available logo pin to both display the logo pin and secure the eyeglass holder to the user's garments.

Another object of the present invention is to allow the user to change from one logo pin design to another.

Other objects of the present invention will become apparent.

IV. THE DRAWINGS

V. DESCRIPTION OF PREFERRED EMBODIMENTS

Figure 1:
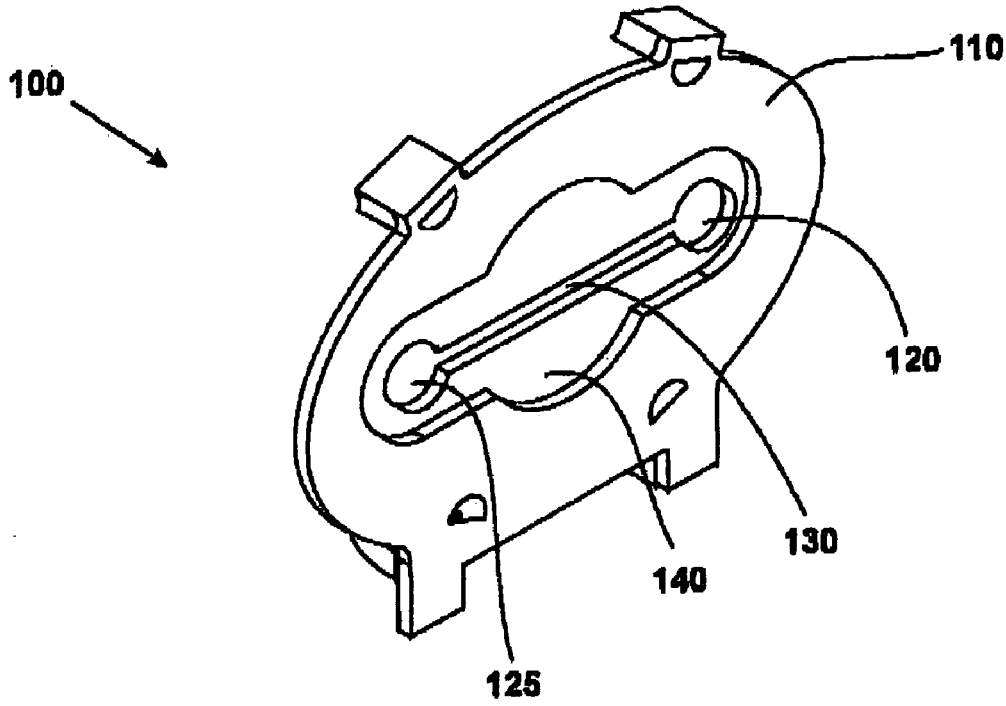
FIG. 1 is perspective view of the present invention, showing its rear side.

In accordance with FIG. 1, the present invention is shown generally at 100. The rear side of combination logo pin holder and eyeglasses holder 100 shows body 110, holes 120, 125, groove 130, and recess 140. The combination logo pin holder and eyeglasses holder li intended to be molded all in one piece from a durable plastic having the properties of strength with limited flexibility.

Figure 2:
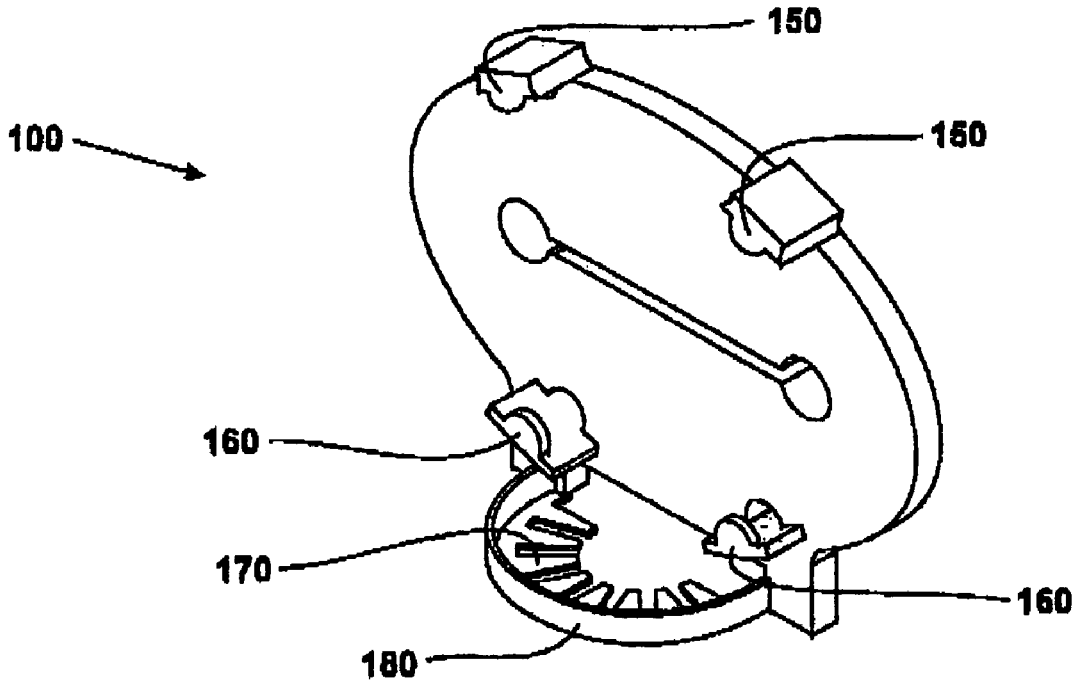
FIG. 2 is a is a perspective view of the present invention, showing its front side.

In accordance with FIG. 2, the front side of combination logo pin holder and eyeglasses holder 100 shows upper retainers 150, lower retainers 160, fingers 170, and eyeglass retainer 180.

Figure 3:
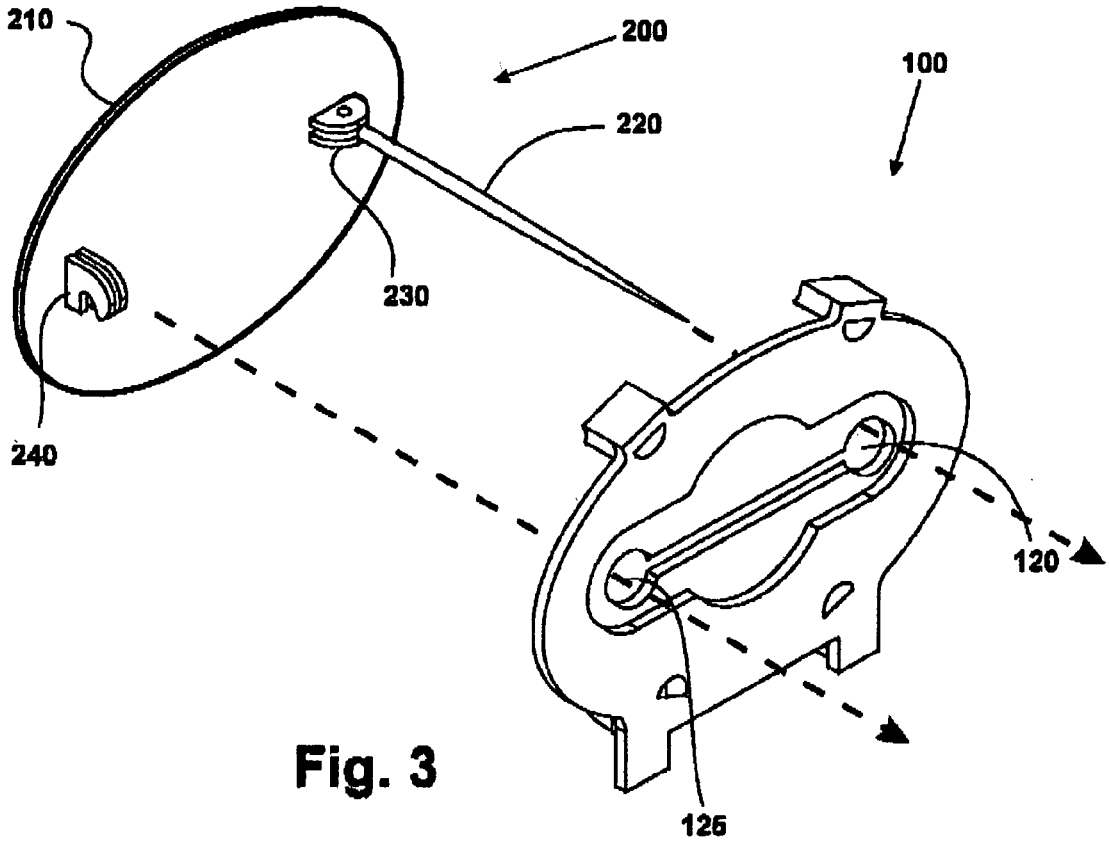
FIG. 3 is a perspective view of the present invention showing how a logo pin may be inserted.

In accordance with FIG. 3, logo pin 200, is shown just prior to being inserted in combination logo pin holder and eyeglasses holder 100. Logo pins are commonly available in souvenier and gift shops, special events, and other venues. The desired style of logo pin is generally oval shaped, comprising body 210, hinge 230, spike 220, and clasp 240. Clasp 240 Will protrude through hole 125; while spike 220 and hinge 230 will protrude through hole 120. The suggested method of inserting logo pin 200 into combination logo pin holder and eyeglasses holder 100 is to flux it slightly and insert logo pin 200 between upper retainers 150 and lower retainers 160, while guiding spike 220, hinge 230, and clasp 240 through corresponding holes 120, 125.

Figure 4:
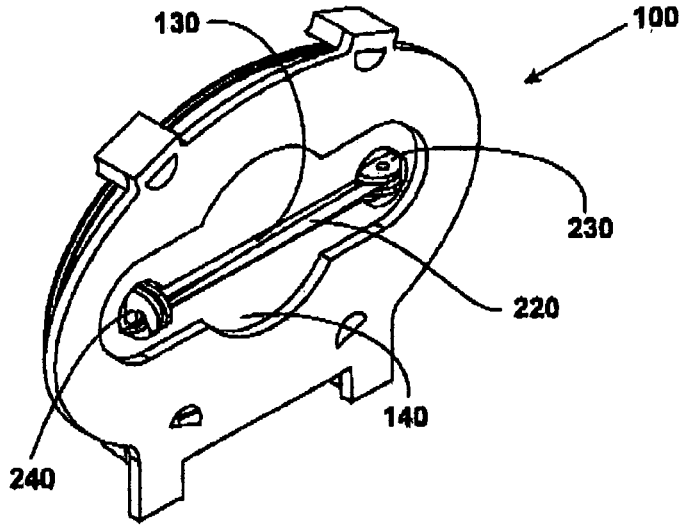
FIG. 4 is a perspective view of the present invention after the logo pin is in place.

In accordance with FIG. 4, logo pin 200 is in place. Spike 220 is shown in the closed position. In use, spike 220 will normally pierce the outer garment of the user before it is inserted into clap 240. This method holds the logo pin to the user's garment, with combination logo pin holder and eyeglasses holder 100 securely sandwiched in between.

Figure 5:
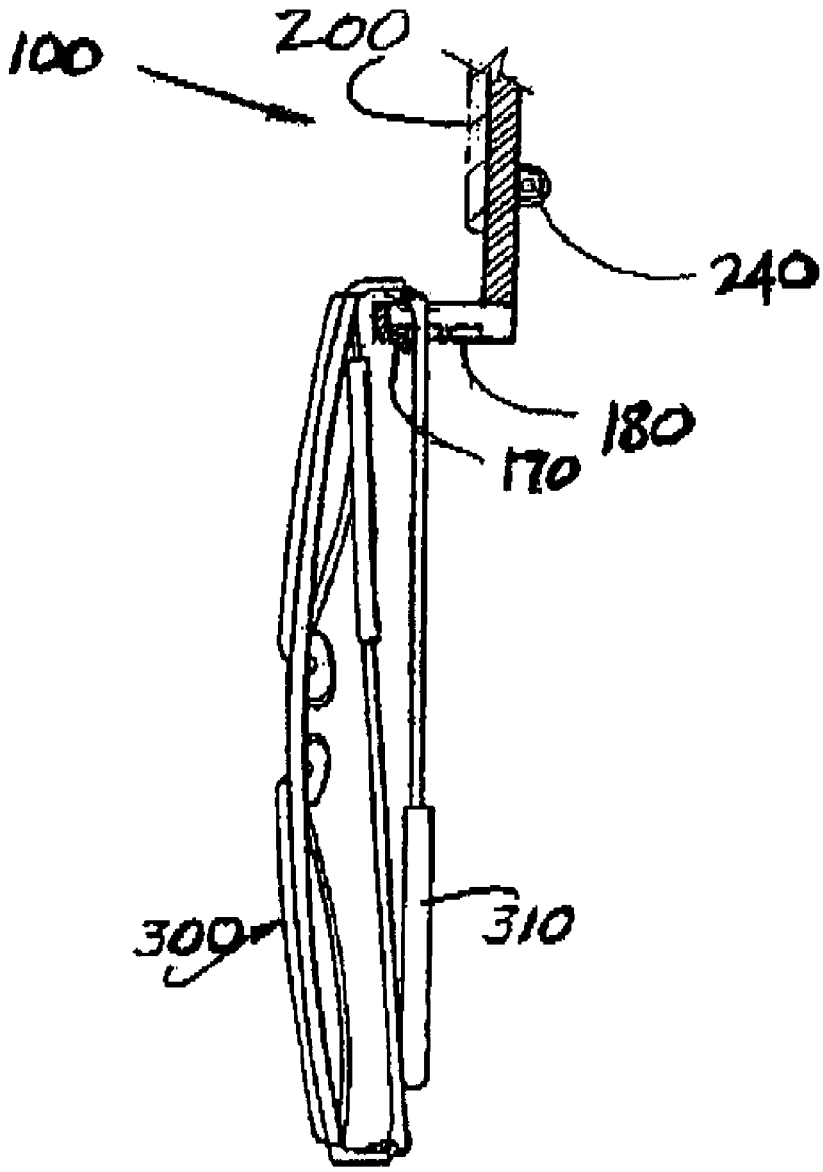
FIG. 5 is a perspective view of the present invention showing a pair of glasses depending from the holder and a logo pin in place.

In accordance with FIG. 5, logo pin 200 is shown captured between upper retainers 150 and lower retainers 160. A pair of eyeglasses 300 is shown with one temple 310 inserted into eyeglasses retainer 180. Flexible fingers 170 help prevent eyeglasses 300 from failing out of combination logo pin holder and eyeglasses holder 100.

What is claimed is:

1. A combination logo pin holder and eyeglass holder comprising:

means to retain a logo pin and allow its spike and clasp to protrude through said retaining means thus affixing said combination holder anywhere upon a user's garment generally horizontal, and means to hold eyeglasses generally vertical outwardly of said retaining means and prevent the eyeglasses from falling out of said holder, while allowing ease of insertion and removal of the eyeglasses from said holder, said holding means being generally perpendicular to said retaining means;

wherein said means allowing a logo pin's spike and clasp to protrude comprise two holes at each end of a groove said holes of greater width than said groove to receive the spike and clasp hingedly connected wherein the eyeglass holder effectively becomes an extension of the logo pin for affixing the holder to a user's garment.

* * * * *